US009085743B2

(12) United States Patent
Yoon et al.

(10) Patent No.: US 9,085,743 B2
(45) Date of Patent: Jul. 21, 2015

(54) LOW VISCOSITY DIESEL ENGINE OIL COMPOSITION WITH IMPROVED FUEL EFFICIENCY

(75) Inventors: WonJin Yoon, Gyeonggi-do (KR); Do-Kon Jeong, Gyeongsangbuk-do (KR)

(73) Assignees: Hyundai Motor Company, Seoul (KR); Kia Motors Corporation, Seoul (KR); S-Oil Corporation, Seoul (KR)

( * ) Notice: Subject to any disclaimer, the term of this patent is extended or adjusted under 35 U.S.C. 154(b) by 90 days.

(21) Appl. No.: 12/939,301

(22) Filed: Nov. 4, 2010

(65) Prior Publication Data

US 2012/0028862 A1 Feb. 2, 2012

(30) Foreign Application Priority Data

Jul. 29, 2010 (KR) ..... 10-2010-0073607

(51) Int. Cl.
*C10M 161/00* (2006.01)
*C10M 145/14* (2006.01)
*C10M 135/18* (2006.01)

(52) U.S. Cl.
CPC ..... *C10M 161/00* (2013.01); *C10M 2203/1006* (2013.01); *C10M 2205/02* (2013.01); *C10M 2207/026* (2013.01); *C10M 2209/084* (2013.01); *C10M 2215/223* (2013.01); *C10M 2215/28* (2013.01); *C10M 2219/068* (2013.01); *C10M 2223/045* (2013.01); *C10M 2229/02* (2013.01); *C10N 2220/021* (2013.01); *C10N 2230/02* (2013.01); *C10N 2230/06* (2013.01); *C10N 2230/10* (2013.01); *C10N 2230/54* (2013.01); *C10N 2230/68* (2013.01); *C10N 2240/10* (2013.01); *C10N 2240/102* (2013.01)

(58) Field of Classification Search
USPC ..... 508/433, 469, 371, 363
See application file for complete search history.

(56) References Cited

U.S. PATENT DOCUMENTS

| | | | | | |
|---|---|---|---|---|---|
| 4,358,565 | A | * | 11/1982 | Eckert | 525/280 |
| 4,846,983 | A | * | 7/1989 | Ward, Jr. | 508/363 |
| 5,622,924 | A | | 4/1997 | Sakai et al. | |
| 5,638,873 | A | | 6/1997 | Burns | |
| 5,863,873 | A | | 1/1999 | Bovington | |
| 6,147,035 | A | * | 11/2000 | Sougawa et al. | 508/192 |
| 2010/0130395 | A1 | * | 5/2010 | Tagawa et al. | 508/552 |

FOREIGN PATENT DOCUMENTS

| | | | |
|---|---|---|---|
| CN | 101311254 | A * | 11/2008 |
| EP | 2071009 | A1 | 6/2009 |
| KR | 10-1999-014470 | | 2/1999 |
| KR | 10-0298035 | | 9/2000 |
| KR | 10-2010-0049350 | A | 5/2010 |

* cited by examiner

*Primary Examiner* — James Goloboy
(74) *Attorney, Agent, or Firm* — Mintz Levin Cohn Ferris Glovsky and Popeo, P.C.; Peter F. Corless

(57) ABSTRACT

The present invention provides an engine oil composition containing polymethylacrylate, zinc alkyldithiophosphate, molybdenum dithiocarbamate, a hindered phenol antioxidant, and a fixed mineral oil. The engine oil composition of the present invention has a low-temperature viscosity The fuel efficiency of the engine oil is improved, when the engine oil composition with an improved low-temperature performance, a maintained high-temperature viscosity, an improved wear resistance, and an improved oxidation resistance is used. Further, the durability of the engine oil can also be ensured when the engine oil composition of the present invention is used.

6 Claims, 1 Drawing Sheet

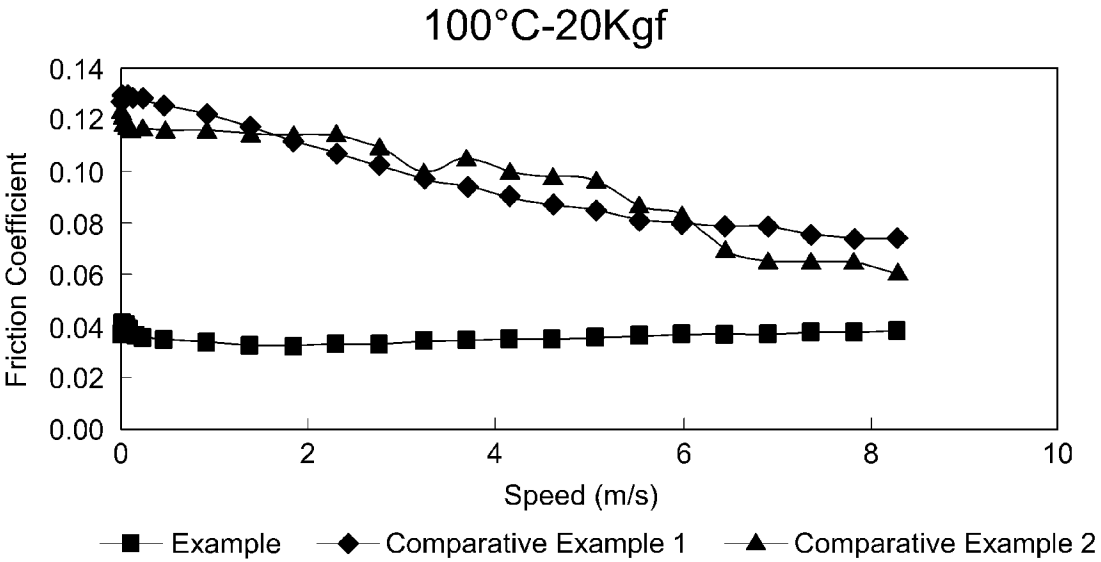
100°C-20Kgf
Friction Coefficient
0.14
0.12
0.10
0.08
0.06
0.04
0.02
0.00
0
2
4
6
8
10
Speed (m/s)
Example
Comparative Example 1
Comparative Example 2

LOW VISCOSITY DIESEL ENGINE OIL COMPOSITION WITH IMPROVED FUEL EFFICIENCY

CROSS-REFERENCE TO RELATED APPLICATION

This application claims under 35 U.S.C. §119(a) the benefit of Korean Patent Application No. 10-2010-00 73607, filed Jul. 29, 2010, the entire contents of which are incorporated herein by reference.

BACKGROUND (a) Technical Field

The present disclosure relates generally to an engine oil composition. More specifically, it relates to a diesel engine oil composition with improved fuel efficiency and durability.

(b) Background Art

The fuel efficiency of an engine oil can be improved when drag torque and friction in the sliding region of the engine are reduced. When the viscosity of the engine oil is reduced, the drag torque may be reduced. However, the friction and wear in the sliding region of the engine may be increased in such a case. Therefore, to improve the fuel efficiency of an engine oil by reducing its viscosity, it seems necessary to use an additive or additives to maintain its viscosity at high temperatures, and to reduce the friction and wear of an engine.

In general, olefin copolymer is added to the engine oil as a viscosity index improver, and zinc alkyldithiophosphate and molybdenum are added together as an anti-wear agent.

The durability of the engine oil is affected by many factors, for example, a reduction in performance of the engine oil due to oxidation, the generation of sludge due to friction and wear, and the deterioration of the engine oil itself When the engine oil has been used under high and low temperatures for a long time, its durability is reduced due to the generation of sludge because of oxidation, thermal decomposition, thermal polymerization, and other reactions that have occurred. As such, an appropriate antioxidant is required to improve the oxidative stability of the engine oil.

When the friction and wear occur at high temperatures and in the boundary lubrication region, excessive heat is generated, which leads to the increase in the viscosity of the engine oil and the total amount of acid contained thereof. The generation of sludge is also increased, thereby reducing the durability of the engine oil. In such circumstances, an anti-wear agent is also needed to prevent the friction and wear. Further, when the engine oil is used under severe conditions, the viscosity index improver that may have been added to the engine oil will be destroyed, thereby causing the engine oil film to become thinner, which results in an increase in the friction and wear. In other circumstances, the friction and wear may be further increased when the anti-wear agent is depleted due to a long-term use.

In the situations when a diesel engine is employed, incomplete combustion products and soot particles, will be generated through the operation. As time goes on, the size of soot particles as generated increases due to attractive forces between molecules. It follows that the viscosity of the engine oil increases, which in turn increases the wear and the sludge generation. The generated soot and sludge may block the oil flow, which reduces the fuel efficiency and the durability of the engine oil. In circumstances like this, it is necessary to use a dispersant to disperse the soot particles. Furthermore, the carbon and sulfur contained in the fuel and engine oil could be oxidized during fuel combustion to produce sulfuric acid and nitric acid. As a result, the total acid amount increases in the engine oil. And polar organic compounds as generated will be accumulated in engine pistons. In such circumstances, it is also necessary to use a detergent to neutralize the acid and to prevent the accumulation of contaminants in the pistons.

U.S. Pat. No. 5,863,873 discloses an additive, which contain polymethylacrylate, zinc alkyldithiophosphate, and molybdenum dithiocarbamate. Korean Patent Publication No. 10-1999-0014470 discloses an engine oil containing molybdenum dithiocarbamate. However, according to these techniques, whenever the low-temperature viscosity of the engine oil is reduced, the high-temperature viscosity is also reduced, which is disadvantageous as the durability of the engine oil at high temperatures is reduced, and the wear resistance of engine parts is also reduced. Moreover, although these techniques provide the friction reduction effect in the boundary lubrication region, only insignificant friction reduction effect in the fluid lubrication region is observed.

Therefore, there is an urgent need in the field for engine oil compositions with improved fuel efficiency and durability.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention relates to a low-viscosity engine oil composition with improved fuel efficiency and durability. The engine oil composition in accordance with the present invention includes a viscosity index improver, an anti-wear agent, and an antioxidant. The engine oil composition of this invention has a reduced viscosity at low temperatures, while its high-temperature viscosity is maintained, an improved oxidative stability, and an improved wear resistance. It is believed that the fuel efficiency and durability of the engine oil of the present invention are improved compared to those existing in the field.

In one embodiment, the present invention provides a engine oil composition comprising polymethylacrylate, zinc alkyldithiophosphate, and a hindered phenol antioxidant. In certain embodiments, the engine oil composition further comprises molybdenum dithiocarbamate. In one embodiment, the engine oil composition further includes a fixed mineral oil. In a particular embodiment, the engine oil composition is a diesel engine oil composition.

Other aspects and preferred embodiments of the invention are discussed infra.

The term "vehicle", "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example, vehicles powered both with gasoline and electricity.

The above and other features of the invention are discussed infra.

BRIEF DESCRIPTION OF THE DRAWINGS

The above and other features of the present invention are further described in detail with reference to certain exemplary embodiments thereof illustrated the accompanying drawings which are given herein below by way of illustration only, and thus are not limitative of the present invention, and wherein:

FIG. 1 shows the measurement results of friction coefficients in Test Example 3.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the FIGURES, reference numbers refer to the same or equivalent parts of the present invention.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

In one embodiment, the present invention provides an engine oil composition containing: 2 to 25 wt % of polymethylacrylate; 0.05 to 5 wt % of zinc alkyldithiophosphate; 0.5 to 2 wt % of molybdenum dithiocarbamate; 0.05 to 1 wt % of a hindered phenol antioxidant; and 70 to 90 wt % of a fixed mineral oil.

A viscosity index improver can be added to an engine oil to improve the performance of the engine oil at low-temperatures p, to increase the viscosity of the engine oil, and to improve the oil's shear stability. Further, the use of a viscosity index improver can attribute to a decreased production of harmful by-products, and improved thermal stability and oxidative stability of the engine oil. When the low-temperature viscosity of the engine oil (measured by a cold cranking simulator) is low, it means that the performance of the engine oil at low temperatures is good. The performance of the engine oil can be improved through the addition of a viscosity index improver to increase the viscosity index. However, on one hand, the viscosity index is increased proportionally to the polarity of a polymer that is used as the viscosity index improver. On the other hand, the solubility of the polymer is reduced when its polarity increases. The present inventor has successfully achieved optimized viscosity index through increasing the polarity of the polymer used as the viscosity index improver, while maintaining a good solubility of the polymer. Further, it is believed that, while the viscosity index increases in proportion to the molecular weight of the viscosity index improver, the viscosity of the engine oil under high-temperature high-shear conditions tends to be in inverse proportion to the molecular weight. In this regard, the present inventor has achieved an improved viscosity index together with an improved high-temperature high-shear viscosity through optimizing the molecular weight of the viscosity index improver.

Polymethylacrylate, olefin copolymer (OCP), and hydrogenated-styrene-diene copolymer are generally used in the field as viscosity index improvers in the engine oil. Polymethylacrylate as a viscosity index improver has excellent low-temperature performance and shear stability compared to the hydrogenated-styrene-diene copolymer and olefin copolymer.

Polymethacrylate containing an alkyl group generally has a high viscosity index, which prevents wax generation. Further, an oil film will be formed due to an increased high-temperature high-shear viscosity. As such, it is believed that no wear will occur in the lubrication region where the temperature of the engine oil reaches 150° under severe friction conditions Further, the high-temperature high-shear viscosity is reduced at lower temperatures such as, about 80 to 100° C. Accordingly, the fuel efficiency of the engine is improved under various conditions. Moreover, the excellent shear stability can help to prevent the viscosity index improver from being damaged in the situations where the engine is operated under severe conditions for a long time. As a result, the chance that a permanent reduction in viscosity due to the damage of the viscosity index improver is minimized, and the performance of the engine oil is maintained, thereby ensuring the long life durability of the engine oil.

In one embodiment, the engine oil composition in accordance with the invention contains polymethylacrylate in the amount of 2 to 25 wt %. It is believed that, if the amount of polymethylacrylate is less than 2 wt %, the fluidity of the engine oil at low temperatures is reduced, thereby reducing the startability of the engine at low temperatures. On the other hand, if the amount of polymethylacrylate exceeds 25 wt %, the viscosity is reduced due to the shear of the viscosity index improver, and the viscosity is increased because of oxidation. Therefore, it is preferable that polymethylacrylate is used in the above range. Moreover, it is believed that the low-temperature performance may be improved by optimizing the polarity of the polymer contained in the polymethylacrylate and its molecular weight thereof. In one particular embodiment, the polymethylacrylate used in accordance with the invention has a molecular weight of between about 100,000 to about 150,000.

In certain embodiments, zinc alkyldithiophosphate is used as an anti-wear agent. Examples of zinc alkyldithiophosphate that may be used includes primary zinc alkyldithiophosphates and secondary zinc alkyldithiophosphates. Primary and secondary zinc alkyldithiophosphates are named according to the structure of alkyl group. Primary zinc alkyldithiophosphates are excellent in terms of thermal decomposition temperature, and the second zinc alkyldithiophosphates are excellent in terms of load resistance performance. In certain embodiments, the primary and secondary zinc alkyldithiophosphates are used together in a ratio of between about 1:0.5 to 1:5. In one embodiment, zinc alkyldithiophosphate is used in the amount of 0.05 to 5 wt % of the engine oil composition. It is believed that, if the amount of zinc alkyldithiophosphate is less than 0.05 wt %, the wear resistance will be reduced, whereas, if it exceeds 5 wt %, sludge will be generated.

In another embodiment, molybdenum dithiocarbamate is used as a friction reducing agent, which reacts with metal in the boundary and extreme pressure lubrication regions to produce a film in the form of molybdenum disulfide, thereby reducing the friction coefficient. As a molybdenum, monoalkyl molybdenum dithiocarbamate may be used as an organic molybdenum additive. In one embodiment, monoalkyl molybdenum dithiocarbamate contains an alkyl group having a carbon number of 8 to 13. In another embodiment, molybdenum dithiocarbamate containing molybdenum in the amount of between about 8 to 15 wt % and sulfur in the amount of between about 10 and 12 wt % is used. In still another embodiment, the engine oil composition contains molybdenum dithiocarbamate in the amount of 0.5 to 2 wt %. It is believed that, if the amount of molybdenum dithiocarbamate is less than 0.5 wt %, the friction reduction effect is reduced, and if it exceeds 2 wt %, molybdenum dithiocarbamate is not dissolved during the production of the engine oil and the sludge will be generated when the engine oil is used at high temperatures.

In certain embodiment, the engine oil composition includes an antioxidant, which contains at least one selected from the group consisting of a chain reaction inhibitor, a peroxide decomposer, a metal deactivator, and a mixture thereof. In certain instances, the antioxidant contains a chain reaction inhibitor as its main component. The chain reaction inhibitor is used herein to inhibit the oxidation at an early stage Examples of a chain reaction inhibitor that may be used include a hindered phenol (e.g., 2,6-di-tertiary-butyl-para-cresol and 4,4'-methylenebis(6-tertiary-butyl-o-cresol)) and an aromatic amine (e.g., dioctylphenylamine and phenyl-alpha-naphthalene). In a preferred embodiment, 2,6-di-tertiary-butyl-para-cresol as a hindered phenol antioxidant is used. In certain embodiments, a hindered phenol antioxidant is used in the amount of between 0.05 to 1.0 wt %. It is believed that, if the amount of the hindered phenol antioxidant is less than 0.05 wt %, the antioxidative effect is reduced. On the other hand, if the amount exceeds 1.0 wt %, no further improvement effect will be obtained.

In certain embodiments, the engine oil compositions further include at least one fixed mineral oil, which has a kinematic viscosity of between about 3 to about 10 cSt at 100° C. The fixed mineral oil is a base oil containing an aromatic compound in the amount of less than 0.1 wt % and having a viscosity index of 120 or higher. As aromatic compounds can be easily oxidized at high temperatures, it is believed that the oxidative stability of the fixed mineral oil will be increased when the amount of the aromatic compound is decreased. Further, it is believed that if the viscosity index is greater than 120, change in the viscosity according to the variation of the temperature becomes less significant As such, the performance of the engine oil is improved under varied temperatures. In one particular embodiment, the fixed mineral oil is used in the amount of between about 70 to 90 wt % of the engine oil composition. The present invention is further described in detail with reference to examples. However, the present invention is not limited by the following examples.

EXAMPLE & COMPARATIVE EXAMPLES

Preparation of Diesel Engine Oils

Diesel engine oils were prepared using the components listed in Table 1.

TABLE 1

| Classification | Name of compound | Example 1 | Comparative Example 1 | Comparative Example 2 |
|---|---|---|---|---|
| Base oil | High viscosity index mineral oil | 78.3 | 88.3 | 88.5 |
| Viscosity index improver | Polymethylacrylate | 13 | | |
| | Olefin copolymer | | 4 | 3 |
| Anti-wear agent | Zinc alkyldithiophosphate | 2 | 2 | 3 |
| Molybdenum | Molybdenum dithiocarbamate | 0.7 | | |
| Antioxidant | 2,6-di-tertiary-butyl-para-cresol | 0.5 | 0.5 | 0.3 |
| Ashless dispersant | Polyisobutylene succinimide | 5.0 | 5.0 | 4.5 |
| Antifoaming agent | Polysiloxane | 0.2 | 0.2 | 0.2 |
| Anti-corrosion agent | Benzotriazole | 0.3 | | 0.5 |

Base oil: Ultra-S from S-Oil Co., Ltd.
Polymethylacrylate: PAS-9006 from Sanyo Chemical
Zinc alkyldithiophosphate (ZnDTP): from Infineum
Molybdenum dithiocarbamate (MoDTC): SC-525 (containing about 10% molybdenum and about 11% sulfur) from Adeka Co., Ltd.
2,6-di-tertiary-butyl-para-cresol: from Ciba
Polyisobutylene succinimide: from Infineum
Polysiloxane: from Shin-Etsu
Benzotriazole: from Infineum
(Unit: wt %)

Test Example 1

Measurement of Kinematic Viscosity and High-Temperature High-Shear Viscosity The kinematic viscosity and high-temperature high-shear viscosity of the prepared diesel engine oils were measured in accordance with ASTM D=2270 (kinematic viscosity) and ASTM D-4683 (high-temperature high-shear viscosity). The results as measured are shown in the following table 2.

TABLE 2

| Classification | | Example 1 | Comparative Example 1 | Comparative Example 2 |
|---|---|---|---|---|
| Kinematic | at 40° C. | 54.16 | 68.34 | 65.08 |
| Viscosity (cSt) | at 100° C. | 10.38 | 10.41 | 10.35 |
| Shear Viscosity (cP) | at 80° C. | 9.73 | 11.27 | 10.89 |
| | at 100° C. | 6.35 | 7.71 | 7.41 |
| | at 150° C. | 3.24 | 3.25 | 3.23 |

As shown in Table 2, the kinematic viscosity of the engine oil prepared in accordance with Example 1 is significantly lower at 40° C. than those of Comparative Examples 1 and 2, while the kinematic viscosity the engine oil prepared in Example 1 is similar at 100° C. to those of Comparative Examples 1 and 2. Further, the shear viscosity of the engine oil prepared in Example 1 at about 80 to 100° C. is lower than those of Comparative Examples 1 and 2, while the shear viscosity of the engine oil prepared in Example 1 is similar at 150° C. to those of Comparative Examples 1 and 2. Accordingly, it is believed that the engine oil of the present invention can improve the fuel efficiency of the engine under various conditions. And the durability of the engine oil may also be improved.

Test Example 2

Evaluation of Fuel Efficiency

An engine test was conducted in accordance with ASTM D-6837 (Seq. –6B, M-111 FE) to evaluate the fuel efficiency of the engine oil The results are shown in the following table 3.

TABLE 3

| Classification | Example 1 | Comparative Example 1 | Comparative Example 2 |
|---|---|---|---|
| Initial Fuel Efficiency (after 16 hours) Fuel Efficiency Improvement Rate (%)* | 1.3 | 0.6 | 0.5 |
| Initial Fuel Efficiency (after 96 hours) Fuel Efficiency Improvement Rate (%)* | 1.0 | 0.3 | 0.3 |

*The fuel efficiency improvement rate was evaluated by measuring the amount of fuel consumed and comparing it with that of a standard engine oil (Hyundai Mobis's genuine oil, Passenger diesel engine oil 5W-30 for DPF equipped vehicle)

It has been observed that, while the viscosity grades of the engine oils are all the same as 5W-30, the viscosity of the engine oil prepared in Example 1 is similar to that of Comparative Example 2, and the viscosity of the engine oil prepared in Comparative Example 1 is relatively low.

As shown in table 3, the fuel efficiency improvement rate of the engine oil according to Example 1 is higher than those of Comparative Examples 1 and 2. Table 3 also shows that the performance of the engine oil is excellent, as the fuel efficiency of the engine oil prepared according to Example 1 is maintained for a long time.

Test Example 3

Evaluation of Friction and Wear

Evaluation of friction and wear was performed on a ball-on-disk machine at a temperature of 100° C., a load of 200 N, and a speed of 0 to 8 m/s. Average friction coefficients and wear depths at a speed of 0 to 8 m/s were measured. The results are shown in the following table 4. The friction coefficients measured according to a change in speed are presented in FIG. 1.

As shown in table 4 and FIG. 1, the friction coefficient of the engine oil prepared according to Example 1 is reduced by 50% compared to that of Comparative Examples 1 and 2, and the wear depth is also reduced by more than 50% compared to that of Comparative Examples 1 and 2. The results prove that the friction properties and wear resistance of the engine oil prepared according to Example 1 are excellent.

TABLE 4

| Classification | Example 1 | Comparative Example 1 | Comparative Example 2 |
|---|---|---|---|
| Friction Coefficient | 0.03 | 0.08 | 0.07 |
| Wear depth (μm) | 18 | 34 | 40 |

Test Example 4

Evaluation of Durability of Ermine (Evaluation of High-Temperature Oxidation of Ermine Oil)

OM-602A test was carried out to evaluate the properties such as viscosity increase, wear resistance, and piston cleanliness of engine oil. The results are shown in the following table 5. As shown in table 5, the piston cleanliness of the engine oil according to Example 1 is excellent compared to those of Comparative Examples 1 and 2, while the changes in viscosity, total base number, and total acid amount of the engine oil according to Example 1 are smaller than those of Comparative Examples 1 and 2.

TABLE 5

| Classification | Test | Example 1 | Comparative Example 1 | Comparative Example 2 |
|---|---|---|---|---|
| Viscosity (at 100° C., cSt) | Before test | 10.38 | 10.41 | 10.35 |
| | After test | 25.60 | 42.02 | 38.30 |
| | Difference (after – before) | 15.22 | 31.61 | 27.95 |
| Total acid number (mgKOH/g) | Before test | 3.41 | 3.08 | 2.24 |
| | After test | 3.74 | 5.01 | 3.78 |
| | Difference (after – before) | 0.33 | 1.93 | 1.54 |
| Total base number (mgKOH/g) | Before test | 7.35 | 7.04 | 6.04 |
| | After test | 6.69 | 4.69 | 4.50 |
| | Difference (after – before) | –0.66 | –2.35 | –1.54 |
| Evaluation of Piston Cleanliness, Rating* | | 3.98 | 3.21 | 3.58 |

*The piston cleanliness was evaluated in accordance with CEC M-02-A-78, and the evaluation results are graded from 1 to 10. The higher number represents that there is no deposit and thus the performance is excellent.
The total acid number was evaluated in accordance with ASTM D-664.
The base number was evaluated in accordance with ASTM D-2896.

As described above, the diesel engine oil of the present invention may help to improve the fuel efficiency by improving the low-temperature performance and to increase the durability with its improved the oxidative stability and wear resistance. Further, the increased durability of the engine oil can attribute to reduce the deterioration of the engine oil, thereby further improving the fuel efficiency of the engine.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. An engine oil composition comprising:

10-13 wt % of polymethylacrylate, having a molecular weight of between about 100,000 and about 150,000;

0.05 to 5 wt % of zinc alkyldithiophosphate;

0.5 to 2 wt % of molybdenum dithiocarbamate with an alkyl group having a carbon number of 8 to 13;

0.05 to 1 wt % of a hindered phenol antioxidant; and 70 to 90 wt % of at least one mineral oil comprising one or more aromatic compounds in an amount of less than 0.1 wt %, and having a viscosity index of 120 or higher.

2. The engine oil composition of claim 1, wherein molybdenum dithiocarbamate comprises about 8 to 15 wt % of molybdenum and about 10 to 12 wt % of sulfur.

3. The engine oil composition of claim 1, wherein the mineral oil has a kinematic viscosity of about 3 to 10 cSt at 100° C.

4. An engine oil composition consisting essentially of:

10-13 wt % of polymethylacrylate, having a molecular weight of between about 100,000 and about 150,000;

0.05 to 5 wt % of zinc alkyldithiophosphate;

0.5 to 2 wt % of molybdenum dithiocarbamate with an alkyl group having a carbon number of 8 to 13;

0.05 to 1 wt % of a hindered phenol antioxidant; and 70 to 90 wt % of at least one mineral oil comprising one or more aromatic compounds in an amount of less than 0.1 wt %, and having a viscosity index of 120 or higher.

5. The engine oil composition of claim 4, wherein molybdenum dithiocarbamate comprises about 8 to 15 wt % of molybdenum and about 10 to 12 wt % of sulfur.

6. The engine oil composition of claim 5, wherein the mineral oil has a kinematic viscosity of about 3 to 10 cSt at 100° C.

* * * * *